US008017215B2

(12) United States Patent
Kuo

(10) Patent No.: US 8,017,215 B2
(45) Date of Patent: Sep. 13, 2011

(54) PAPER CUSHION

(76) Inventor: Sheng-Hsi Kuo, Hsinchu (TW)

( * ) Notice: Subject to any disclaimer, the term of this patent is extended or adjusted under 35 U.S.C. 154(b) by 182 days.

(21) Appl. No.: 12/612,681

(22) Filed: Nov. 5, 2009

(65) Prior Publication Data

US 2011/0101011 A1 May 5, 2011

(51) Int. Cl.
*B65D 81/133* (2006.01)

(52) U.S. Cl. ..... 428/122

(58) Field of Classification Search ..... 428/122; 206/586, 453; 229/199; 248/345.1
See application file for complete search history.

(56) References Cited

U.S. PATENT DOCUMENTS 7,754,310 B2 * 7/2010 Kuo ..... 428/122

* cited by examiner

*Primary Examiner* — Alexander Thomas

(57) ABSTRACT

A paper cushion includes a hollow, elongated, corrugated support member having a longitudinal section of U and two open ends; two hollow fixing members having a cross-section of U and comprising two leg members and a corrugated portion on an outer surface; and two brace members comprising a first leg, a second leg being in parallel with the first leg, and a connection member interconnecting the first and second legs. The leg members of the fixing members are inserted into both ends of the support member with the corrugated portions of the fixing members being exposed. The second leg of each brace member is inserted into a gap between an inner surface of the fixing member and the outer surface thereof with the first leg of each brace member being urged against the inner surface of the fixing member.

3 Claims, 5 Drawing Sheets

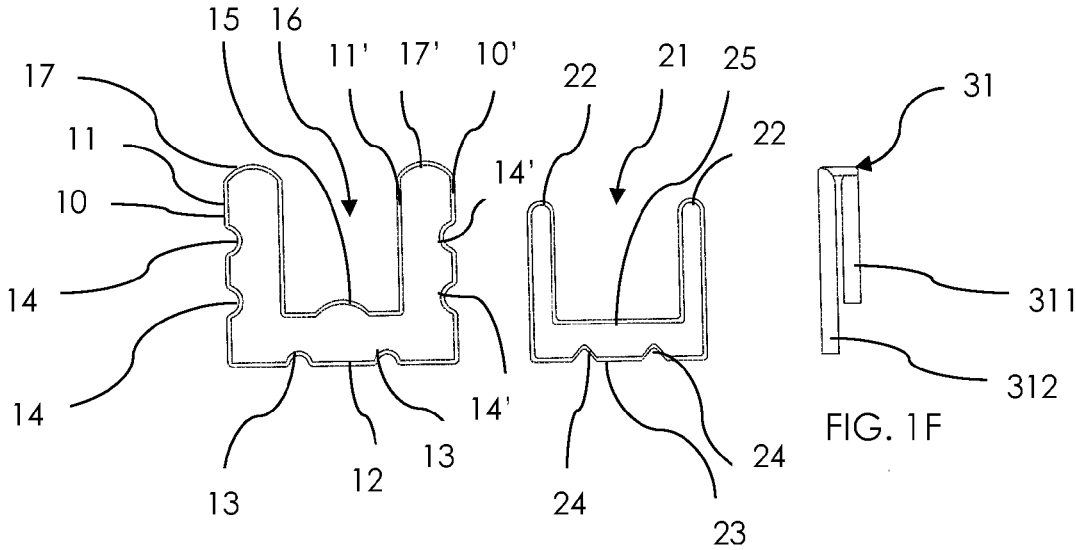
FIG. 1D
FIG. 1E
FIG. 1F
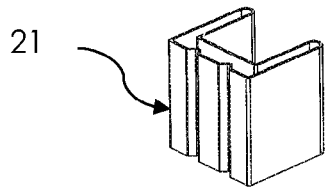
FIG. 1B
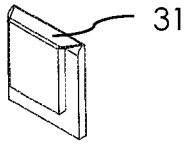
FIG. 1C
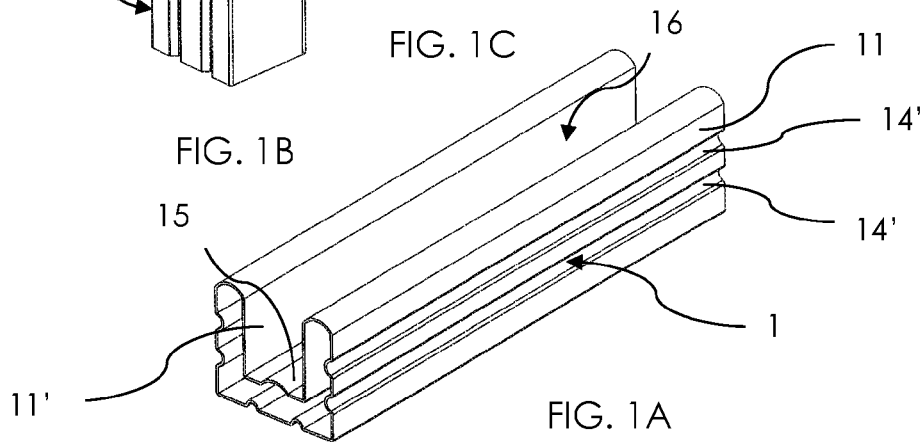
FIG. 1A

PAPER CUSHION

BACKGROUND OF THE INVENTION

1. Field of Invention

The invention relates to cushioning materials and more particularly to a paper-based cushioning structure with improved characteristics.

2. Description of Related Art

A package cushioning is typically inside a shipping container (e.g., corrugated box) It is known that high price articles (e.g., notebook computers) are required to be fully protected during transport. Conventionally, cushioning material in packaging is either expanded polystyrene foam (styrofoam) or paper-based material. For styrofoam, it is, among other reasons, not environmentally friendly (i.e., a pollution to the environment) and not biodegradable.

For paper cushions, various types and styles thereof are commercially available. Paper cushions are more environmentally friendly. However, conventional paper cushions do not provide sufficient resiliency or offer complete protection to article(s) packaged in a paper container.

There have been numerous suggestions in prior patents for cushioning structure. For example, U.S. Pat. No. 6,464,080 discloses a spring type cushioning structure. Thus, continuing improvements in the exploitation of paper cushioning structure are constantly being sought.

SUMMARY OF THE INVENTION

It is therefore one object of the invention to provide a paper cushioning structure.

The above and other objects, features and advantages of the invention will become apparent from the following detailed description taken with the accompanying drawings.

BRIEF DESCRIPTION OF THE DRAWINGS

FIG. 1A is a perspective view of support member as a first component of a preferred embodiment of one of a pair of paper cushioning structures according to the invention;

FIG. 1B is a perspective view of fixing member as a second component of the paper cushioning structure;

FIG. 1C is a perspective view of brace member as a third component of the paper cushioning structure;

FIG. 1D is a longitudinal sectional view of the support member;

FIG. 1E is a longitudinal sectional view of the fixing member;

FIG. 1F is a side elevation of the brace member;

DETAILED DESCRIPTION OF THE INVENTION

Figure 2:
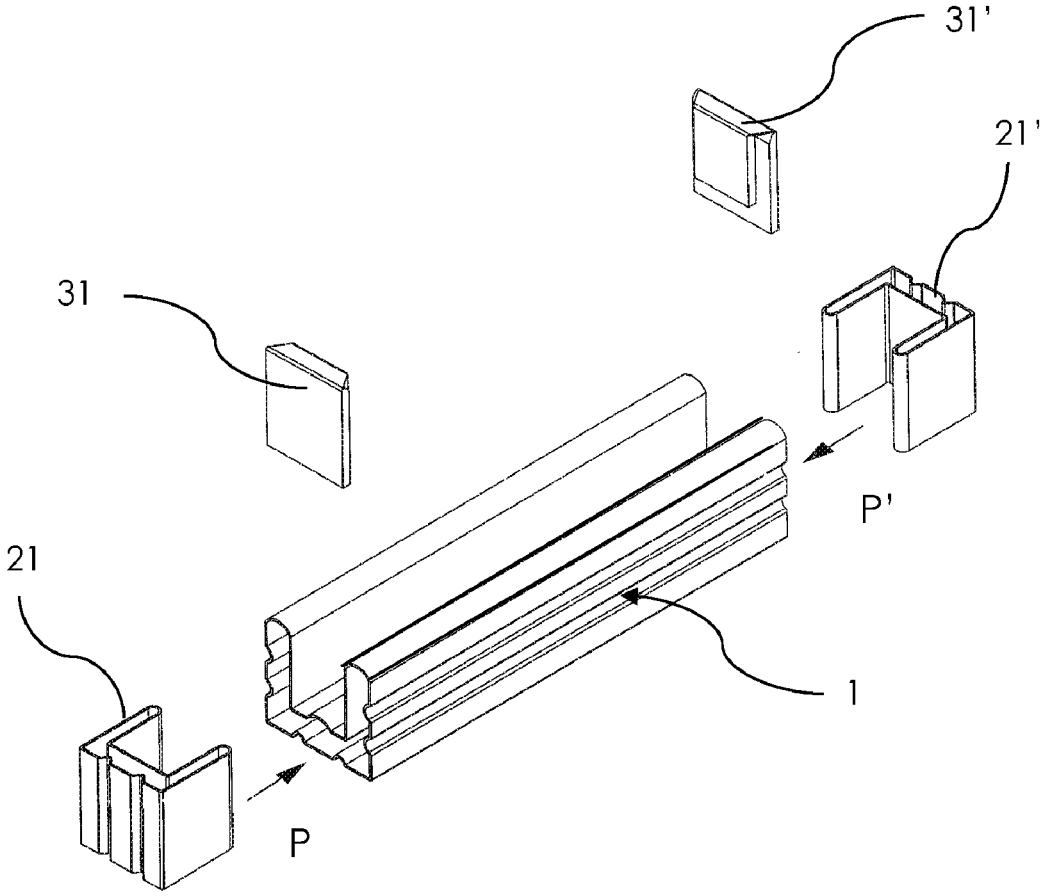
FIG. 2 is an exploded view of the paper cushioning structure prior to assembly.

Referring to FIGS. 1 to 4, one of a pair of paper cushioning structures in accordance with a preferred embodiment of the invention comprises the following components as discussed in detail below.

An elongated support member 1 is hollow and has both ends open. The support member 1 has a longitudinal section of U. The support member 1 is corrugated in order to withstand multiple cycles of impact. The support member 1 comprises a lengthwise channel 16, an inner surface 11' having smooth side walls and a lengthwise, arcuate projection 15 on a bottom of the channel 16, and a corrugated outer surface 11 having two parallel first grooves 13, on a bottom 12, two parallel second grooves 14 on one side 10, and parallel third grooves 14' on the other side 10', and two arcuate side tops 17, 17' interconnecting the inner and outer surfaces 11', 11 (see FIG. 1D).

Two hollow fixing members 21, 21' each has a cross-section of U. The fixing member 21 comprises a smooth inner surface 25, two parallel fourth grooves 24 on one of three portions of an outer surface 23, two arcuate side tops 22 interconnecting the inner and outer surfaces 25, 23 (see FIG. 1E). The fixing member 21' comprises a smooth inner surface 25', two parallel fourth grooves (not numbered) on one of three portions of an outer surface 23', two arcuate side tops (not numbered) interconnecting the inner and outer surfaces 25', 23'.

Two brace members 31, 31' are provided. The brace member 31 comprises a short leg 311, a long leg 312 parallel with the short leg 311 with a gap formed therebetween, and a connection member 313 interconnecting tops of the legs 311, 312, the connection member 313 having two inclined ends 314. The brace member 31' comprises a short leg 311', a long leg 312', and a connection member 313' interconnecting tops of the legs 311', 312', the connection member 313' having two inclined ends 314'.

Figure 3:
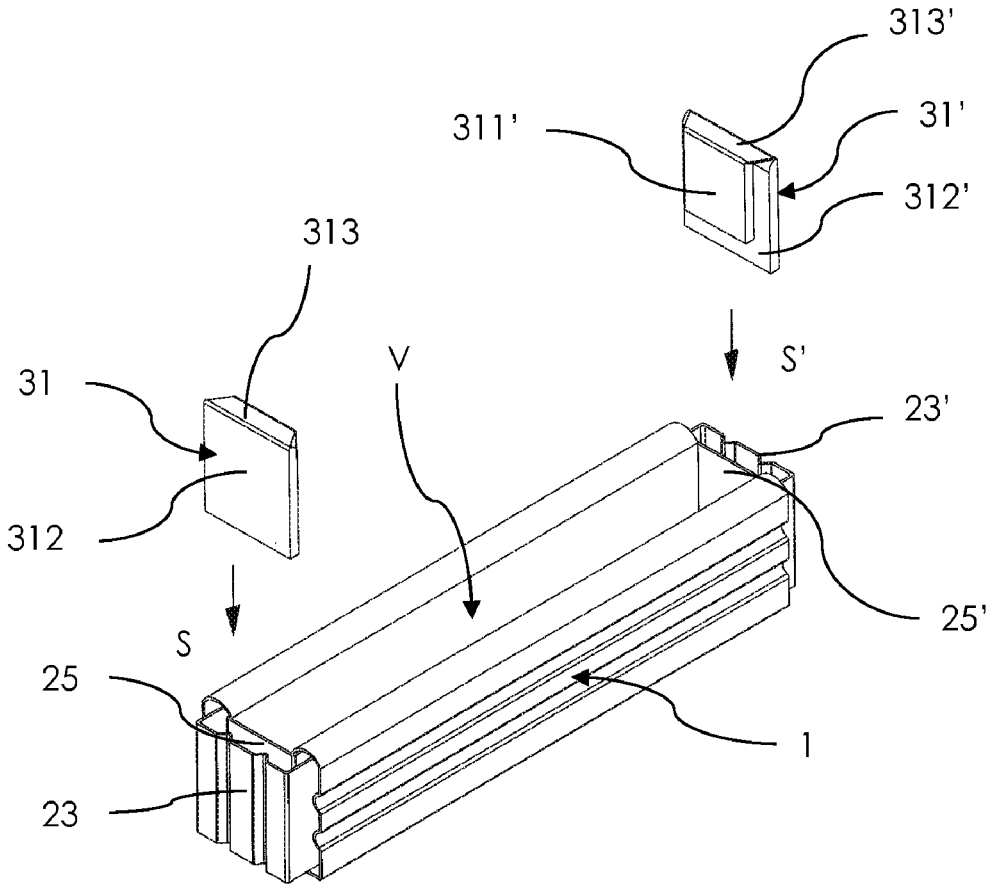
FIG. 3 is another exploded view of the paper cushioning structure being partially assembled.

Steps of assembling one of the pair of paper cushioning structures will be described in detail below. First, insert legs of one fixing member 21 into one side of the support member 1 (as indicated by arrow P) and insert legs of the other fixing member 21' into the other side of the support member 1 (as indicated by arrow P') until being stopped as shown in FIGS. 2 and 3. The support member 1 and the fixing members 21, 21' are substantially fastened together. A receiving space V is thus defined by the channel 16, one of three portions of the inner surface 25, and one of three portions of the inner surface 25' (see FIG. 3).

Figure 4:
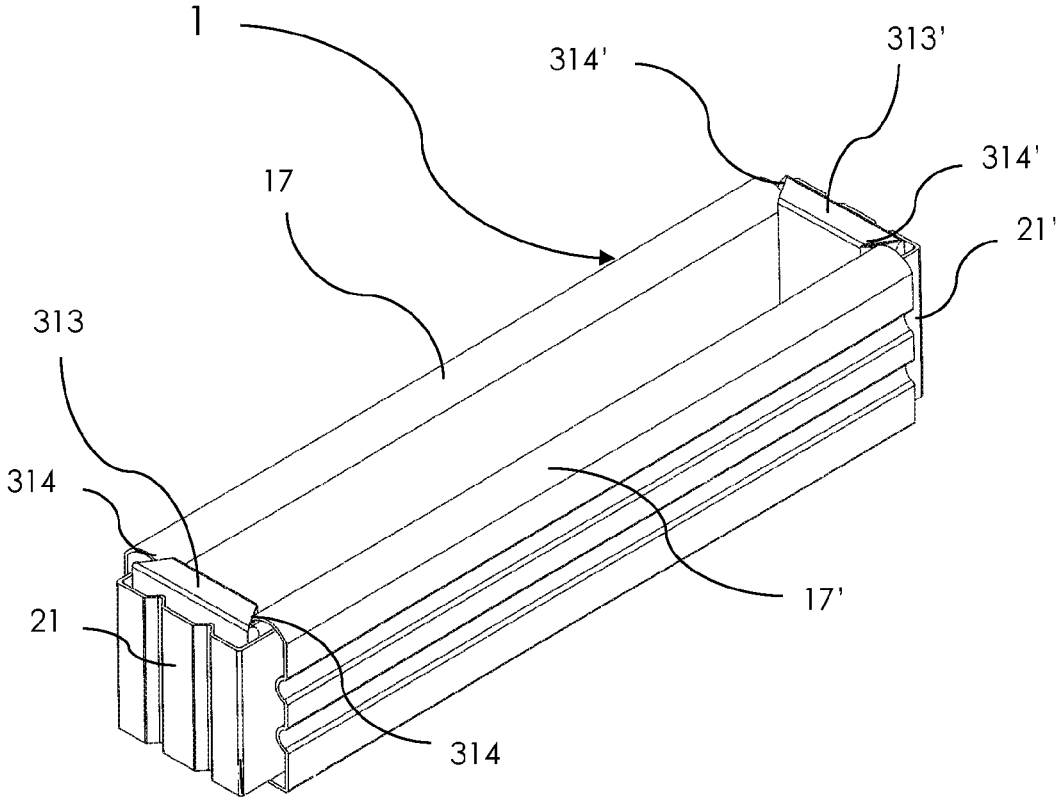
FIG. 4 is a perspective view of the assembled paper cushioning structure.

Next, insert the long leg 312 of one brace member 31 into a narrow space between the inner and outer surfaces 25 and 23 (as indicated by arrow S) and insert the long leg 312' of the other brace member 31' into a narrow space between the inner and outer surfaces 25' and 23' (as indicated by arrow S') until being stopped as shown in FIGS. 3 and 4. In this position, the short legs 311, 311' are disposed in the receiving space V. Also, the long leg 312 is tightly clamped between the inner and outer surfaces 25 and 23, the long leg 312' is tightly clamped between the inner and outer surfaces 25' and 23', one of three portions of the inner surfaces 25 is tightly clamped by the long and short legs 312, 311, and one of three portions of the inner surfaces 25' is tightly clamped by the long and short legs 312', 311' respectively.

Figure 5:
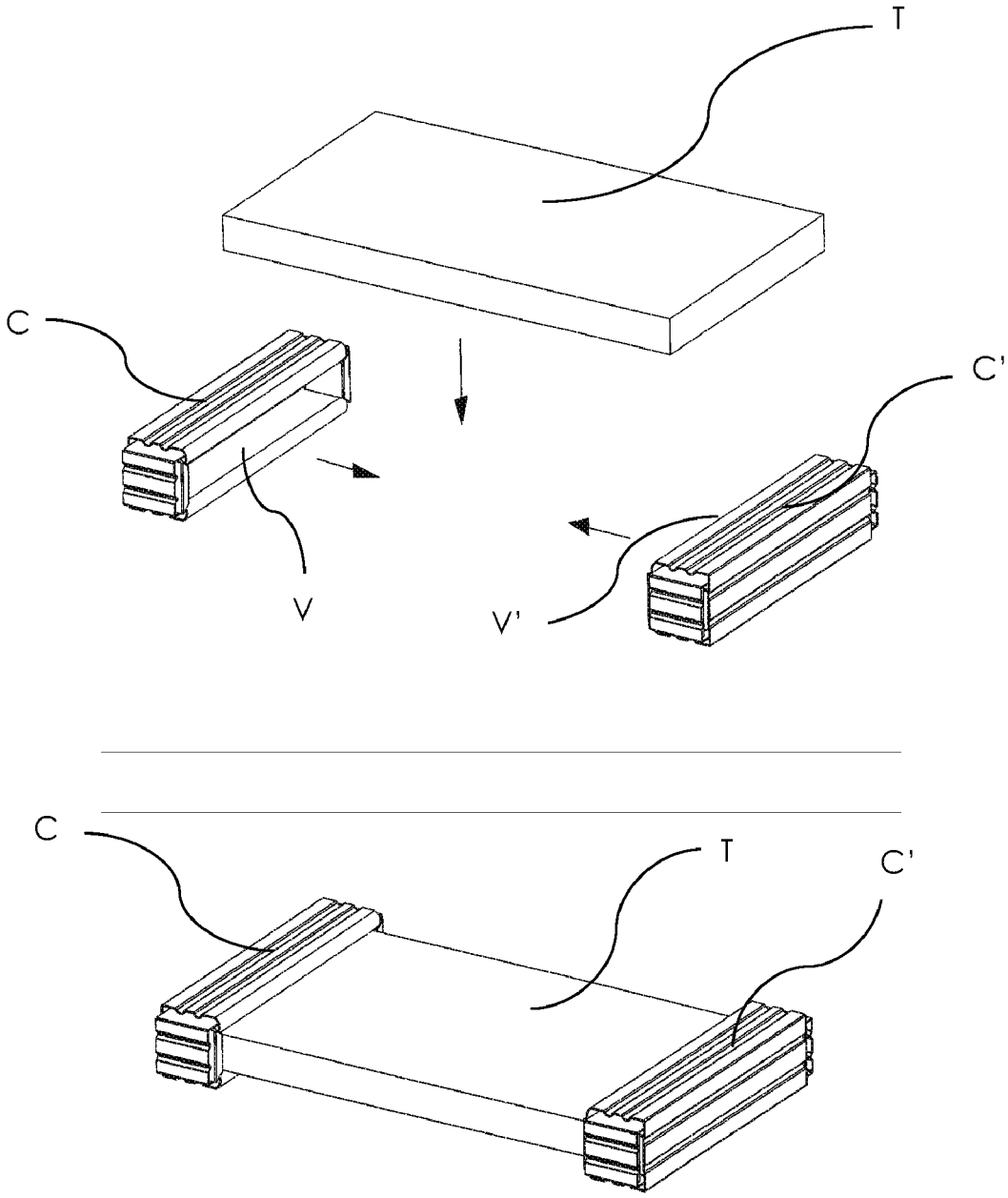
FIG. 5 is a view depicting a final step of fixing an article by means of the pair of paper cushioning structures prior to packaging in a shipping container.

Referring to FIG. 5, an article T has one end tightly inserted into a receiving space V of one paper cushioning structure C and the other end tightly inserted into a receiving space V' of the other paper cushioning structure C' respectively. That is, the paper cushioning structures C, C' are served as end caps of a package.

It is envisaged by the invention that the paper cushioning structures are particularly suitable for transportation of notebook computers, fragile mechanical devices, fragile optical devices, ceramic products, glass products, etc.

While the invention herein disclosed has been described by means of specific embodiments, numerous modifications and variations could be made thereto by those skilled in the art without departing from the scope and spirit of the invention set forth in the claims.

What is claimed is:

1. A paper cushioning structure comprising:

a hollow, elongated, corrugated support member having a longitudinal section of U and two open ends;

two hollow fixing members having a cross-section of U and comprising two leg members and a corrugated portion on an outer surface; and two brace members comprising a first leg, a second leg being in parallel with the first leg, and a connection member interconnecting the first and second legs, wherein the leg members of the fixing members are inserted into both ends of the support member with the corrugated portions of the fixing members being exposed, and the second leg of each of the brace members is inserted into a gap between an inner surface of the fixing member and the outer surface thereof with the first leg of each of the brace members being urged against the inner surface of the fixing member.

2. The paper cushioning structure of claim 1, wherein the second leg has a length greater than that of the first leg.

3. The paper cushioning structure of claim 1, wherein the connection member has two inclined ends.

* * * * *